United States Patent [19]

Hyler

[11] 3,934,360

[45] Jan. 27, 1976

[54] ELEVATING-TYPE SCRAPER HAVING FORWARDLY SLIDING FLOOR AND FULL-WIDTH PIVOTED STRIKER

[75] Inventor: John H. Hyler, Peoria, Ill.

[73] Assignee: Westinghouse Air Brake Company, Pittsburgh, Pa.

[22] Filed: Oct. 31, 1974

[21] Appl. No.: 519,534

[52] U.S. Cl. ..... 37/8; 37/129

[51] Int. Cl.[2] ..... E02F 3/85

[58] Field of Search ..... 37/8, 126, 129

[56] References Cited

UNITED STATES PATENTS

| | | | |
|---|---|---|---|
| 3,210,869 | 10/1965 | Hein | 37/8 |
| 3,274,711 | 9/1966 | Johnson et al. | 37/8 X |
| 3,292,278 | 12/1966 | Johnson | 37/8 |
| 3,474,548 | 10/1969 | Miller | 37/8 |
| 3,521,388 | 7/1970 | Simmons | 37/8 X |

*Primary Examiner*—Stephen C. Pellegrino
*Attorney, Agent, or Firm*—Wolfe, Hubbard, Leydig, Voit & Osann, Ltd.

[57] ABSTRACT

An elevating type scraper for earth moving purposes having an open-fronted bowl with a scraper blade along the leading edge and with a rearwardly inclined elevator for sweeping the loosened soil from the blade into the bowl. The back of the bowl and the base of the blade are fixed to provide bowl reinforcement. The bottom of the bowl is enclosed by a horizontally slidable floor member for movement from an enclosing position forwardly into an out-of-the-way position nested under the blade base. In the preferred embodiment, the floor consists of two sections, a front floor member and a "mid" floor member which are arranged substantially edge-to-edge but which are simultaneously moved to a stacked position under the blade base. Rearwardly of the mid floor member is a full-width pivoted strike-off member which is hinged under the back of the bowl, having a horizontal enclosing position and a vertical striking position. Means are provided for moving the floor members forwardly and for simultaneously dropping the strike-off member into vertical striking position so as to uncover substantially the entire bottom area of the bowl for prompt discharge of the collected soil which is thereupon leveled, full width, by the striker blade.

13 Claims, 8 Drawing Figures

ELEVATING-TYPE SCRAPER HAVING FORWARDLY SLIDING FLOOR AND FULL-WIDTH PIVOTED STRIKER

BACKGROUND OF THE INVENTION

The invention relates generally to an earth moving device in the form of a tractor-drawn scraper into which soil is propelled by an elevator and which has improved means for dumping the soil when the scraper bowl is filled.

When operating under wet conditions, or in clayey soils, the soil which is collected in the scraper bowl is not easily dislodged. It has been the practice in the past to employ a floor having a fixed rear section and a rearwardly sliding front section to uncover a front discharge opening. The back wall of the bowl is commonly in the form of an ejector plate which is thrust forwardly by actuators to push the soil into a position over the front opening. The effect of the ejector plate is often to compact the soil into a tight mass which becomes firmly stuck to the side sheets of the bowl and tightly jammed into the flights of the elevator, both effects, combined with the relatively small area of the opening, tending to cause the soil to become "hung-up" in the bowl. Moreover, it is found that when using bowls having a length which is greater than the width dimension, the tendency of the mass of soil to expand outwardly toward the side walls, in the case of clayey soils, produces a bracing reaction which may be sufficiently strong as to block the ejector plate completely against further forward movement. Thus while conventional elevator-type scrapers work very well in soils which are relatively dry and friable, it is sometimes necessary, in the case of wet clayey soils, to suspend operations temporarily until the soil loses some of its moisture. Such lost time is costly to the contractor.

It is, moreover, a common expedient in devices of this type to mount the scraper blade at the front edge of the rearwardly slidable floor section so that it, upon retraction, may also serve as a spreader or strike-off device. However, the modern tendency to use relatively narrow scraper blades with projecting ripper teeth to engage the subsoil precludes smooth full-width strike-off or leveling. Also, when the scraper blade is mounted on the forward edge of a rearwardly slidable floor section, the floor section and its mounting must be made quite massive in order to absorb reaction forces, without any benefit to the bowl structure. Then too, where an ejector plate is used in lieu of a back wall, the side sheets cannot rely upon the back wall for lateral bracing so that the bowl tends to be weakened at the back as well as the front. To this must be added the fact that, where an ejector plate is used, provision must be made behind the plate, and between the rear wheels, for relatively massive actuators and actuator mounting elements which, in the case of a scraper having a rear engine, results in serious space and design complications.

SUMMARY OF THE INVENTION

It is accordingly an object of the present invention to provide a floor structure for a scraper which is of simple, trouble-free construction and which easily and quickly opens up for dumping purposes substantially the entire bottom area of the bowl for immediate discharge of the contained load even where such load consists of wet clayey soil and which, in addition, spreads and levels the discharged material evenly across the entire bowl width. It is a general object of the present invention to overcome the various disadvantages which have been associated with prior constructions, particularly of the ejector plate type.

It is another object to provide, in an elevator type scraper, a floor assembly which not only facilitates dumping of difficult materials but which accomplishes its aim using a construction which is inherently inexpensive and capable of operating, trouble-free, over longer periods of time.

This is accomplished using a bowl having a rigidly fixed back wall and a rigid blade base, with the bowl being enclosed at the bottom by a front floor member and a mid floor member arranged substantially edge-to-edge, each of the floor members extending transversely so as to bridge the space between the side sheets. The blade base is of triangular construction having forwardly and rearwardly sloping surfaces, with a generally horizontal bottom surface. The front and mid floor members lie in closely adjacent planes and are supported for horizontal movement upon rails on the side sheets, moving from a bottom-enclosing position forwardly to a vertically stacked, out-of-the-way position under the blade base. Or a single forwardly slidable floor member may be used.

To the rear of the mid floor section, and horizontally hinged under the back wall of the bowl is a strike-off member which occupies a horizontal enclosing position but which is swung downwardly into vertical striking position at the same time that the floor members move forwardly to their out-of-the-way positions, so that substantially the entire bottom area of the bowl opens for prompt discharge of the collected material.

In one of the aspects of the invention separate actuators are used for the floor members and strike-off member while in another form of the invention the strike-off member is cam-actuated by the adjacent floor member.

BRIEF DESCRIPTION OF THE DRAWINGS

FIG. 1 is a side elevation of a complete elevating scraper assembly, including tractor, to which the present invention has been applied;

While the invention has been described in connection with certain preferred embodiments, it will be understood that I do not intend to be limited to the illustrated embodiments but intend, on the contrary, to cover the various alternative and equivalent forms of the invention included within the spirit and scope of the appended claims.

DETAILED DESCRIPTION OF THE PREFERRED EMBODIMENT

Figure 5:
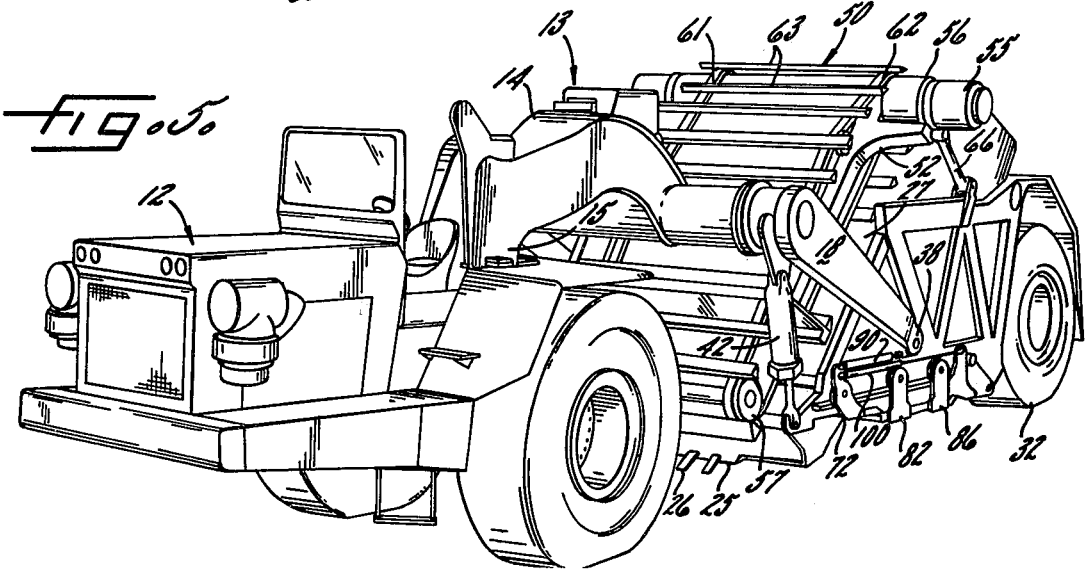
FIG. 5 is a perspective view of the assembly of FIG. 1 taken from the opposite side.

Referring now to the drawings there is disclosed a scraper assembly having a bowl 11 and a tractor 12 interconnected by a draft frame 13. The draft frame includes a so-called gooseneck 14 which is of rigid construction pivoted to the tractor at 15 for horizontal swinging movement and carrying a torque tube 16, to the lateral ends of which are rigidly secured draft members 17, 18 (see also FIG. 5).

The bowl 11 has side sheets 21, 22 which are spanned by a back wall 23. At the front the side sheets are bridged by a blade base 24 which mounts a cutter blade 25 with ripper teeth 26. The bowl has an open front 27 occupied by an elevator to which reference will be made.

The rear end of the bowl structure is supported upon rubber-tired wheels 31, 32 driven by an engine mounted between them. The forward porfion of the bowl is supported by pivotal engagement, at 37, 38, with the rear ends of the draft members 17, 18. The running level of the blade is controlled by actuators 41, 42 which are interconnected between the ends of the torque tube and the front corners of the bowl structure. By extending the actuators 41, 42 the bowl is rocked clockwise, as viewed in FIG. 1, lowering the scraper blade 25 to a predetermined depth of cut. The rear engine, at 33, is optional.

Mounted transversely at the open front end of the bowl is an elevator 50 (see also FIG. 5) having spaced frame members 51, 52 which occupy a rearwardly inclined position. Extending between the members 51, 52 is a top drive shaft 53, having sprocket wheels 54. The shaft 53 is rotated by a motor 55 having a gear box 56. In alined positions at the lower end of the elevator frame are rollers 57 which serve as pulleys. Idlers 59, 60 are provided along the forward edge of the frame. Engaging the sprockets and trained about the rollers are respective conveyor chains 61, 62 having flights 63.

It is apparent, then, that as the motor 55 is rotated, the underside of the elevator engages the soil which has been scalped and loosened by the blade 25, propelling it back into the bowl. To permit upward swinging movement of the elevator to clear obstructions, the elevator is mounted, at each side, on pivoted links 65, 66.

In accordance with the invention a floor structure is provided which, instead of shifting rearwardly as in conventional constructions, is shifted forwardly into an out-of-the-way position under the blade base to open the bottom of the bowl for dumping and distribution. Thus there is provided a front floor member 70 which extends bridgingly between the side sheets and which is supported primarily upon brackets 71, 72 (FIG. 2) having rollers 73, 74. The rollers ride upon horizontal rails 75, 76 respectively secured to the outer surfaces of the side sheets.

Arranged in horizontal position rearwardly of the floor section 70 is a mid floor member 80 suspended at its forward end upon brackets 81, 82 having rollers 83, 84 and suspended at its rear end on brackets 85, 86 having rollers 87, 88, the rollers on each side engaging the same horizontal rail structure 75, 76.

The floor members are, when in enclosing position, arranged substantially end to end with slight overlap, but they occupy adjacent planes extending under the blade base so that the floor members may be shifted forwardly into a stacked out-of-the-way position.

For shifting the forward member 70, an actuator 90 is provided having connection 91 with the side plate and having a connection 92 with bracket 71. To operate the mid floor member 80 a second actuator 100 is provided having a connection 101 with the bracket 71 and a connection 102 with a bracket 103 which forms an extension of the roller bracket 85. It will be understood that for application of balanced forces similar actuators are provided adjacent the opposite side sheet.

In accordance with one of the aspects of the present invention, the blade base 24, which is rigidly secured at its ends to the side sheets, is of triangular cross section having a forwardly sloping surface 111, a rearwardly sloping surface 112, and a generally horizontal bottom surface 113, the bottom surface having a dimension, measured fore and aft, which corresponds, approximately, to the dimension of the slidable floor sections 70, 80. With the floor members 70*a* in the nested positions shown in FIG. 3, the front edges thereof are adjacent to blade 25, with the blade and its teeth 26 extending downwardly in front of the floor members to protect them from any obstruction which may be encountered.

Figure 2:
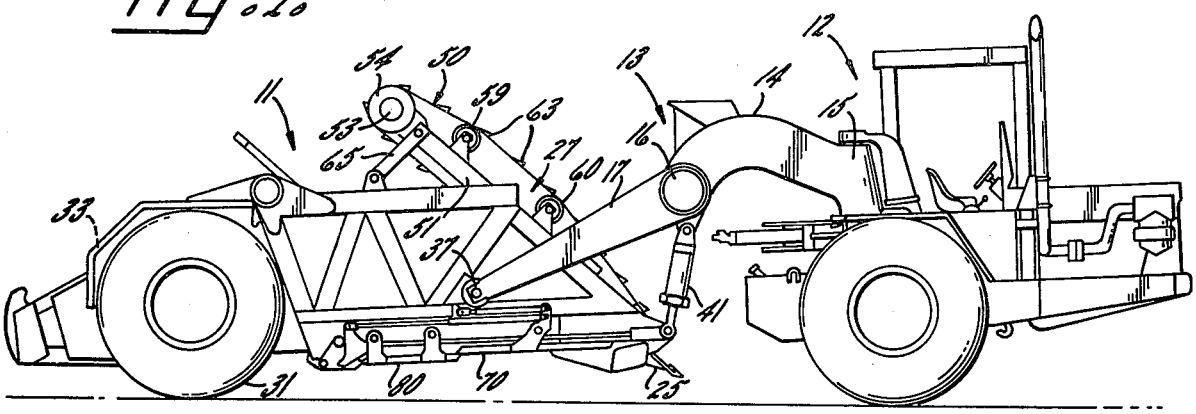
FIG. 2 is an enlarged elevational view of the bowl utilizing one form of the present invention, the elevator and top of the bowl being omitted.
Figure 4:
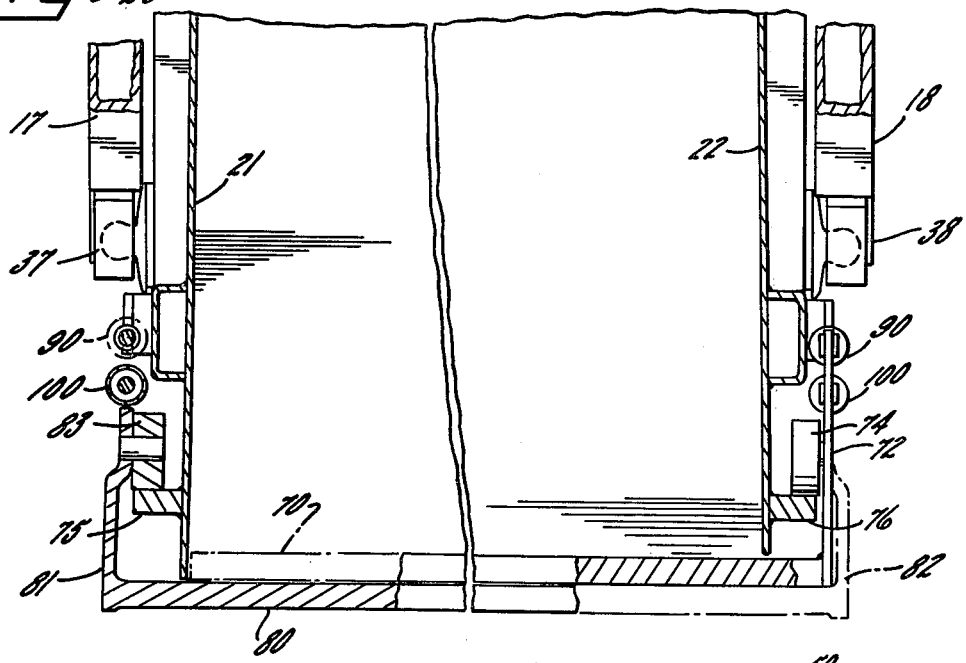
FIG. 4 is a fragmentary vertical section looking along line 4—4 in FIG. 2.
Figures 2A, 3A, 6A:
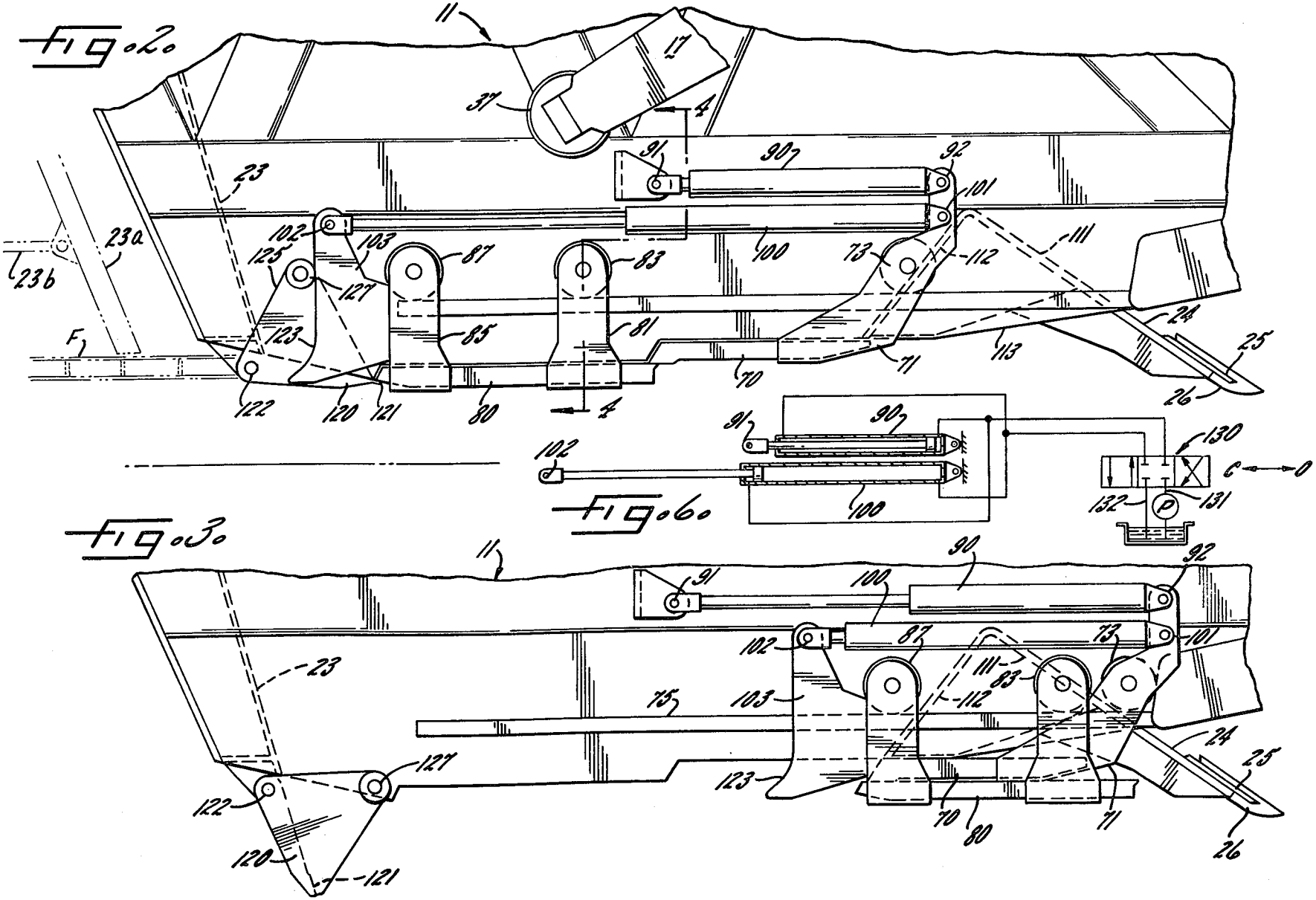
FIG. 3 is a view similar to FIG. 2 but showing the floor in open position.
FIG. 6 is a simplified hydraulic diagram.

As a result when the actuators 90, 100 are pressurized, horizontal force is applied to the members 70, 80 moving them from the enclosing positions illustrated in FIG. 2 forwardly to the open position illustrated in FIG. 3 in which the members are vertically stacked in a nested, out-of-the-way position under the blade base.

Further in accordance with the invention the space rearwardly of the mid floor member 80 is occupied by a strike-off member 120. The strike-off member carries a striker blade 121 at its forward edge which extends substantially the entire bowl width. At its rear end the strike-off member has a hinge 122 which occupies a transversely extending position at the lower end of the back wall 23.

For the purpose of swinging the strike-off member 120 to the enclosing position illustrated in FIG. 2, the bracket 103 is provided, along its rear edge, with a cam surface 123. The member 120, moreover, has brackets 125 at its respective ends, the illustrated bracket 125 carrying a cooperating cam follower roller 127. It will be apparent, then, that when the floor member 80 moves rearwardly the camming edge 123 picks up roller 127 causing the strike-off member 120 to rotate into the enclosed position illustrated in FIG. 2.

In a typical operating sequence, with the floor members and cam follower member occupying the positions illustrated in FIG. 2, the tractor draws the bowl in scalping engagement with the ground. The elevator, driven by motor 55, engages the loosened soil and propels it rearwardly with a sweeping action into the bowl until the bowl is filled. The actuators 41, 42 (FIG. 1) are thereupon contracted to raise the blade out of engagement with the ground, and the tractor is driven to the dumping area. During such travel the flights of the elevator retain the soil in place and prevent leakage.

The hydraulic system used for supplying the actuators 90, 100 may be of rudimentary form, as illustrated in FIG. 6, employing a valve 130, diagrammatically illustrated as being of the slide type, fed by a pressure line 131 and exhausted by a sump line 132. Moving the valve to its extreme positions causes the actuators 90,

100 to expand and contract for opening and closing the floor members.

Upon arrival at the dumping area valve 130 is operated to expand the actuator 90 and contract actuator 100. Expansion of the actuator 90 shifts the floor member 70 forwardly into its nested position and, at the same time, draws the cylinder of the actuator 100 in the forward direction. Contraction of the actuator 100 applies a forwardly directed force to the bracket 103 on the floor member 80 so that it, too, moves forwardly into a position under the member 70, the member 80 moving twice the distance of member 70, since actuator 100 is bodily transported as it contracts.

Forward movement of the floor member 80 releases the cam follower roller 127, permitting the strike-off member 120 to drop into its striking position illustrated in FIG. 3 where it is held by the reaction of the soil which it engages.

It is particularly noteworthy that while sliding floor sections have been previously utilized for uncovering a portion of the bottom area of the bowl, the present construction with its forwardly sliding sections serves to uncover the entire area so that the collected material may drop to the ground promptly and unobstructedly. Because the strike-off member 120 is released during the initial portion of movement of the floor sections, the striker blade 121 immediately assumes its striking position so that all of the soil which emerges from the bottom of the bowl is certain to be acted upon by the blade.

Even wet, clayey soils are promptly discharged. Only natural forces serve to adhere the material to the side sheets. This is to be contrasted with scrapers employing a rear ejection plate in which the ejection force applied to the mass of soil causes the mass to expand laterally in addition to moving forwardly, the lateral expansion causing the sticky soil to be packed adheringly against the side sheets and the forward motion causing the body of the soil to be jammed between the adjacent flights of the elevator, both of which effects are contrary to achieving prompt and efficient discharge.

After the bowl is completely empty, the valve 130 is moved in the opposite direction causing the floor members 70, 80 to move back to their enclosing positions, member 80 moving twice as far as member 70. When the cam surface 123 on bracket 103 engages roller 127 the strike-off member 120 is rotated counterclockwise into its enclosing position.

ALTERNATE EMBODIMENT

Figure 7:
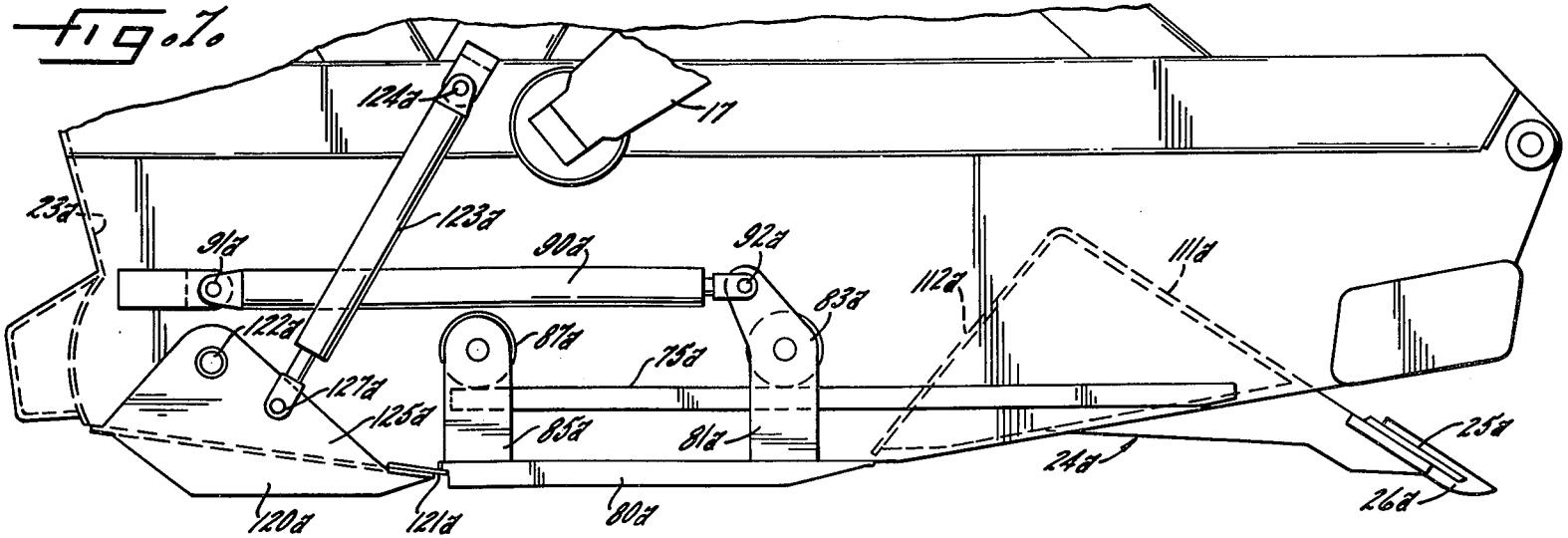
FIG. 7 is an elevational view of an alternate embodiment having a single slidable floor section.

In accordance with one of its aspects, the present invention may be practiced using only a single slidable floor section which is dimensioned to fit under the blade base and using a strike-off member of greater longitudinal extent to bridge the space behind the floor member. Such alternate embodiment is shown in FIG. 7, with corresponding reference numerals, with addition of subscript "a", being used to represent corresponding elements. Thus a slidable floor member 80*a* is used having a bracket 81*a* at its forward end carrying a roller 83*a* and having a bracket 85*a* at its rear end mounting a roller 87*a*. The rollers ride upon a side rail 75*a*. The floor section is moved by an actuator 90*a* connected to the side plate at 91*a* and to the bracket 81*a* at point 92*a*. The floor member 80*a* cooperates with the underside 24*a* of the blade base, the two members having approximately the same dimension so that the floor member, when open, is both out of the way and protected.

Rearwardly of the slidable floor member 80*a* is a pivoted floor member, in the form of a strike-off member 120*a* having a striker blade 121*a* and hinged for swinging about a transverse axis 122*a*. It will be noted that since the strike-off member 120*a* is of longer dimension that the strike-off member 120 of the previous embodiment, the hinge axis is necessarily shifted upwardly and forwardly from the previous location but is still generally at the base of the back wall. To swing the strike-off member 120*a* between its open and closed positions an actuator 123*a* is used, connected at 124*a* to the side sheet and at 127*a* to the side plate 125*a*.

The actuator 123*a*, it will be understood, is connected in parallel with the actuator 90*a* so that the two expand and contract upon movement of the same control valve. However, it is contemplated that the strike-off actuator 123*a*, or actuators, since there is preferably a duplicate actuator on the other side of the bowl, may be separately controlled by an hydraulic system which is the same as that illustrated in FIG. 6. This not only enables precise variable control of striking height, but it permits the handling of broader range of materials. In the extreme case where large boulders must be accommodated when unloading, the strike-off member may be raised to clear them, then lowered again after the obstruction has been passed.

It will be apparent that the present construction abundantly satisfies the objects of the invention. Even though the scraper blade and its ripper teeth may occupy only a portion of the bowl width, the striker blade 121, extending smoothly over the width of the bowl, insures accurate and smooth leveling of the deposited soil by reason of the fact that the position of the striker blade is fixed with respect to the rear supporting wheels which perform the function of gauging wheels. This is to be contrasted with strike-off members which are mounted upon a sliding floor and where progressive rearward movement of the floor produces a progressive change in striking depth.

Since there is no necessity for an ejector plate, no actuating or guiding means are required under the bowl or behind the back wall. As a result, the space behind the wall is free for mounting of rear engine and other appliances and nothing but the basic floor and bowl structure are exposed to the abuse of ground obstruction.

Figure 8:
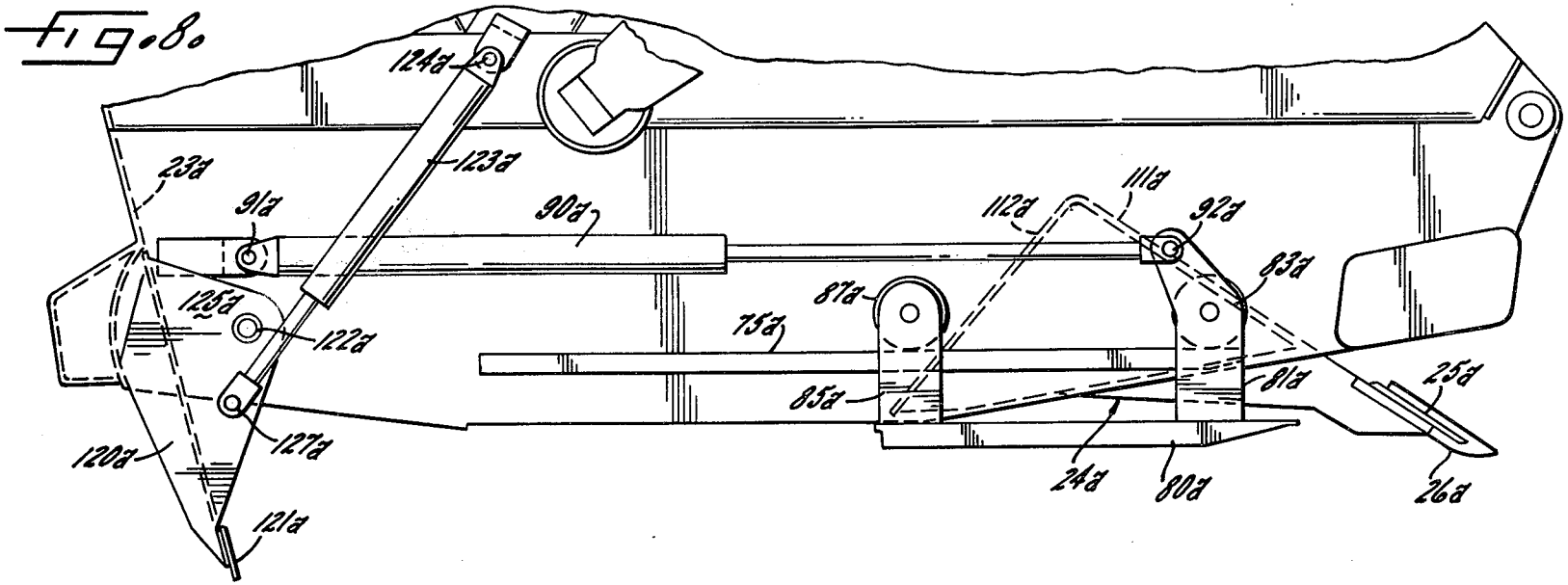
FIG. 8 is a view corresponding to FIG. 7 but showing the floor in open position.

Although it is one of the features of the invention that an ejector plate, with its actuating assembly, may be dispensed with, the present invention may, if desired, be used with a bowl having a fixed rear floor section and associated ejector, the pivoted striker being mounted at the lip of the fixed section. By using both a fixed rear floor and the disclosed movable floor, a bowl of high volumetric capacity can be constructed even though the movable floor sections are kept to narrow stackable width. Thus FIG. 2 shows the manner in which the present invention may be used with a fixed floor section F of any desired fore-and-aft dimension and with the strike-off member 120 being hinged, at 122, to the forward edge thereof. Where a fixed floor is used it will be understood that the back wall 23 shown in FIG. 2 will not be employed and that its function will be performed by a movable ejector plate 23*a* having appropriate thrusting means 23*b*. And, while FIG. 2 shows two forwardly sliding floor sections, the fixed floor section and ejector plate may be used, if desired, with only a single sliding section such as shown in FIGS. 7 and 8, while retaining a strike-off member of the type shown in FIG. 2.

The construction is simple and economical and the floor suspension, it may be noted, employs simple, straight guide rails, rather than "ramped" guide rails. The latter are commonly resorted to where a floor section carries a striker blade capable of thin spread depth for the purpose of securing adequate clearance during collection and transport. The present device obviates such problem and imposes no limit on thinness of spread.

The hydraulic system of FIG. 6 may be changed from "parallel" to "series" by disconnecting the lines which are shown connected to the left-hand ends of the actuators and simply interconnecting such left-hand ends. Where separate hydraulic actuators are used for the strike-off member, as illustrated in FIG. 7, such actuators may be controlled by a separate valve using a control system of the same type illustrated in FIG. 6, permitting the strike-off member to be raised as might be necessary to clear boulders and the like during unloading and for the purpose of achieving a fully adjustable strike-off depth. All of the above advantages, it may be noted, may be achieved using an inherently strong and highly integrated bowl structure in which the back wall and blade base both serve to internally brace the side sheets. As used herein the term "cam" and "cam follower" are interchangeable. The term "horizontal", it will be understood, is not limited strictly thereto but includes general horizontality.

I claim as my invention:

1. In an elevating-type scraper for earth moving purposes, the combination comprising an open-fronted bowl formed of a pair of spaced vertical side sheets and a fixed back wall, ground wheels for supporting the bowl and mounted behind the back wall, a scraper blade having a blade base of triangular section extensive in the fore-and-aft direction with a generally horizontal underside, the blade base extending transversely between the side sheets at the front edge thereof and rigidly secured at its ends to the side sheets for bracing the same with respect to one another, a tractor-supported draft frame, a pair of draft members pivotally secured at their rear ends to the side sheets and extending forwardly and upwardly for rigid connection at their front ends to the draft frame, actuator means coupled to the front end of the bowl for supporting it at a predetermined level with respect to the draft frame so that the blade cuts into the ground, a driven endless elevator positioned at the front end of the bowl having its lower end in proximity to the blade and inclined upwardly and rearwardly for conveying loosened soil from the blade into the bowl, a movable floor member enclosing the bottom of the bowl rearwardly of the blade base and extending transversely to bridge the space between the side sheets, the side sheets of the bowl having horizontal rails, suspension means on the movable floor member for engaging the rails for horizontal movement of the floor member, actuator means for moving the floor member from its enclosing position at the rear of the blade base forwardly to an open out-of-the way position adjacent the blade and nested under the blade base in substantial register therewith, the blade being extended downwardly in front of the nested floor member to protect the same, a strike-off member horizontally pivoted on the bowl and extending transversely so as to bridge the space between the side sheets to the rear of the floor member, the strike-off member having a striker blade at the forward edge thereof and pivoted for movement between a horizontal enclosing position and a generally vertical striking position, and means for moving the strike-off member to its horizontal position incident to movement of the floor member to its enclosing position.

2. The combination as claimed in claim 1 in which the floor member is in first and second sections bridgingly extending between the side plates, the sections being arranged substantially end-to-end when in enclosing position but located in adjacent planes for relative sliding movement so that when the sections are moved forwardly they occupy vertically stacked positions under the blade base.

3. The combination as claimed in claim 2 in which the floor sections each have a fore-and-aft dimension approximately equal to the fore-and-aft dimension of the blade base.

4. The combination as claimed in claim 1 in which the floor member has a camming member at its rear edge and in which the strike-off member is provided with a cooperating cam follower so arranged that when the floor member is forcibly moved rearwardly into enclosing position by the actuator means, engagement of the cam member with the cam follower causes the strike-off member to be cammed upwardly from its vertical position to its horizontal enclosing position.

5. The combination as claimed in claim 2 in which the actuator means includes a first horizontally arranged actuator connected between the bowl and the first section of the floor member as well as a second horizontal actuator connected between the two sections, with means for simultaneously pressurizing the actuators.

6. In a power driven scraper for earth moving purposes, the combination comprising an open-fronted bowl formed of a pair of spaced vertical side sheets and a back wall, ground wheels for supporting the bowl and mounted behind the back wall, a scraper blade having a blade base extending transversely between the sheets at the front edge thereof, a tractor-supported draft frame, a pair of draft members pivotally secured at their rear ends to the side sheets and extending forwardly and upwardly for rigid connection at their front ends to the draft frame, actuator means supporting the bowl at a predetermined level with respect to the draft frame so that the blade cuts into the ground with the loosened soil passing into the bowl, a horizontally shiftable floor member enclosing the bottom of the bowl rearwardly of the blade base and extending transversely to bridge the space between the side sheets, the side sheets of the bowl having horizontal rails, suspension means on the shiftable floor member for engaging the rails, actuator means for moving the floor member from its enclosing position at the rear of the blade base forwardly to an out-of-the way position registered under the blade base, a strike-off member on the bowl and extending transversely so as to bridge the space between the side sheets rearwardly of the floor member, the strike-off member having a striker blade at the forward edge thereof and mounted for movement between a retracted position and a generally vertical striking position, and means for moving the strike-off member to its retracted position incident to movement of the floor member to its enclosing position, the strike-off member being mounted in fixed position with respect to the ground wheels, and ajdacent thereto, so that when the strike-off member is in striking position the striking depth, for a given blade height, remains constant over the range of movement of the floor member, the strike-off member and the floor member cooperating in side-by-side relation to enclose the bottom of the bowl during transport.

7. The combination as claimed in claim 6 in which the means for moving the strike-off member is in the form of a separate actuator having independent means for controlling the same thereby to control the depth of strike off and enabling independent elevation of the strike-off member to accommodate passage of large boulders and the like.

8. The combination as claimed in claim 6 in which the horizontal rails are mounted on the side sheets in elevated position and in which the floor actuator means is in the form of hydraulic actuators mounted horizontally on the side sheets above the respective horizontal rails, the rails and actuator means thus being elevated above the ground to reduce possibility of damage from obstructions and avoiding the necessity for use of floor actuating and guiding means exposed to abuse at ground level.

9. In a power driven scraper for earth moving purposes, the combination comprising an open-fronted bowl formed of a pair of spaced vertical side sheets and a fixed back wall, ground wheels for supporting the bowl and mounted behind the back wall, a scraper blade having a blade base, the blade base being of triangular cross section having surfaces sloping forwardly and rearwardly and having a generally horizontal underside, the blade base being extensive in the fore-and-aft direction and rigidly secured at its ends to the side sheets for bracing the same with respect to one another, a tractor-supported draft frame, a pair of draft members pivotally secured at their rear ends to the side sheets and extending forwardly and upwardly with rigid connection at their front ends to the draft frame, actuator means coupled to the front end of the bowl for supporting it at a predetermined level with respect to the draft frame so that the blade cuts into the ground, a front floor member and a mid-floor member, the floor members being arranged in adjacent planes substantially edge-to-edge for enclosing the bottom of the bowl rearwardly of the blade base, each of the floor members extending transversely so as to bridge the space between the side sheets, the side sheets of the bowl having horizontal guide rails, suspension means on the floor members for engaging the rails, a pivoted strike-off member having a horizontal position in which it extends bridgingly between the side sheets rearwardly of the mid-floor member, floor actuator means for moving the front floor member and mid-floor member to open position stacked out of the way nested under the blade base, and with the front edges of the floor members adjacent the blade, the scraper blade being extended downwardly in front of the nested floor members to protect the same, the rear edge of the front floor member overlapping the mid-floor member for support thereon in enclosing position and during movement to open position, and means for pivoting the strike-off member downwardly into generally vertical strike-off position when the floor members are in open position.

10. The combination as claimed in claim 9, in which the floor actuator means includes a first hydraulic actuator connected between the bowl and the front floor member and a second hydraulic actuator connected between the front floor member and the mid floor member.

11. The combination as claimed in claim 9 in which a cam and cam follower are interposed between the mid floor member and the pivoted strike-off member for causing the latter to move into vertical position as the floor members begin to open.

12. The combination as claimed in claim 9 in which the floor actuator means is in the form of hydraulic actuators horizontally mounted on the side sheets above the respective rails and in which the suspension means includes brackets on the floor members which are coupled at their upper ends to the hydraulic actuators.

13. In a power driven scraper for earth moving purposes, the combination comprising an open-fronted bowl formed of a pair of spaced vertical side sheets and a back wall, ground wheels for supporting the bowl and mounted behind the back wall, a scraper blade having a blade base extending transversely between the sheets at the front edge thereof, a tractor-supported draft frame, a pair of draft members pivotally secured at their rear ends to the side sheets and extending forwardly and upwardly for rigid connection at their front ends to the draft frame, actuator means supporting the bowl at a predetermined level with respect to the draft frame so that the blade cuts into the ground with the loosened soil passing into the bowl, a fixed floor section at the rear of the bowl, the back wall of the bowl being in the form of an ejector plate movable over the fixed floor section, a strike-off member hinged at the front edge of the fixed floor section, the strike-off member having a striker blade at the forward edge thereof and mounted for movement between a horizontal position and a generally vertical striking position, means including a horizontally shiftable floor member normally enclosing the bottom of the bowl between the blade base and strike-off member, the side sheets of the bowl having horizontal rails, suspension means on the shiftable floor member for engaging the rails, actuator means for moving the shiftable floor member from its enclosing position at the rear of the blade base forwardly to an out-of-the way position protectively nested under the blade base and for moving the ejector plate forwardly so that soil is moved out of the space vacated by the shiftable floor member, and means for moving the strike-off member to its striking position for leveling of the soil discharged from the bowl by the ejector plate.

* * * * *